United States Patent [19]

Fox

[11] Patent Number: 4,546,071

[45] Date of Patent: Oct. 8, 1985

[54] SILVERLESS PHOTOGRAPHIC MEDIUM AND PROCESS

[76] Inventor: David Fox, 96 Bud La., Levittown, N.Y. 11756

[21] Appl. No.: 509,319

[22] Filed: Jun. 30, 1983

[51] Int. Cl.[4] ..... G03C 5/24

[52] U.S. Cl. ..... 430/428; 430/440; 430/441; 430/495; 428/15

[58] Field of Search ..... 430/434, 435, 428, 441, 430/440, 372, 374, 495; 428/15

[56] References Cited

U.S. PATENT DOCUMENTS 3,871,888 3/1975 Wolwertz et al. ..... 430/495
4,065,310 12/1977 Dujardin et al. ..... 430/495

FOREIGN PATENT DOCUMENTS 1222675 12/1971 United Kingdom .

OTHER PUBLICATIONS

Kirk-Othmer: Encyclopedia of Chem. Tech., 3rd Ed., vol. 21, pp. 492-496, Jun. 27, 1983.
The New Encyclopaedia Britannica, vol. 14, Apr. 1974, pp. 365-373.
McNally et al. (Abstract) of Ser. No. 35,291, filed May 6, 1970.
Chem. Abs., vol. 90, 1979: 164750d.

*Primary Examiner*—Won H. Louie
*Attorney, Agent, or Firm*—Howard C. Miskin

[57] ABSTRACT

A photographic image was produced by storing a geranium leaf in darkness and then projecting a light image on the leaf for a sufficient time to produce a suitable latent starch image, the leaf then being treated to extract the chlorophyll and then flooded with an iodine solution to stain the starch and develop the photographed image. Alternatively, instead of the leaf, a photographic medium may be employed including a film of a starch free, water, carbon dioxide and light permeable matrix, such as gelatin, having dispersed therein chloroplast containing algae or photosynthetic bacteria.

7 Claims, No Drawings

SILVERLESS PHOTOGRAPHIC MEDIUM AND PROCESS

BACKGROUND OF THE INVENTION

The present invention relates generally to improvements in photography and it relates particularly to an improved photographic medium and process.

In conventional photography the photographic medium employed, whether on film, plates, paper or the like includes as the photosensitive component a silver compound, generally a silver halide such as silver bromide or other halides and mixtures thereof. While the use of silver compounds as a photosensitive component has long proven highly satisfactory, with the high and increasing cost of silver, photographic film, paper and other such products have become very expensive and will most likely continue increasing in price.

SUMMARY OF THE INVENTION

It is a principal object of the present invention to provide an improved photographic medium.

Another object of the present invention is to provide an improved photographic process.

Still another object of the present invention is to provide an improved photographic process and medium in which the use of silver is obviated.

A further object of the present invention is to provide an improved photographic process and medium of the above nature characterized by their low cost and high versatility.

The above and other objects of the present invention will become apparent from a reading of the following description.

It has been discovered that a photographic image can be produced by exposing to a light image having areas of different intensitites, a surface of a starch depleted photographic medium including a water, carbon dioxide and light permeable matrix having chloroplasts dispersed therein and thereafter applying an iodine solution to the exposed surface.

A photographic medium in accordance with the present invention comprises a layer or film of a light, water and carbon dioxide permeable matrix substantially free of starch, and chloroplasts dispersed in the matrix. Advantageously the chloroplasts have their natural matrix associated therewith and may be included in the matrix, as contained in algae or photosynthetic bacteria. In accordance with the process of the present invention, the chloroplast containing photographic medium described above is stored in darkness to deplete it of starch, and in the presence of water and carbon dioxide a surface of the medium is exposed to a light image with different areas having different light intensities to produce a latent starch image, the concentration or amounts of starch varying with the intensities or quantities of the medium incident light. Thereafter the starch is selectively dyed such as by applying an iodine solution to the exposed surface to develop the latent image. Advantageously, the medium chloroplasts are deactivated by extracting the chlorophyll before the development of the latent starch image by bathing the media in boiling alcohol.

The improved photographic process and medium obviate the use of silver and is inexpensive and highly versatile.

DESCRIPTION OF THE PREFERRED EMBODIMENTS

Photographic images were produced, using as the photographic medium, vegetable plant leaves, specifically geranium leaves. A fresh geranium leaf with the end of its stem immersed in water was placed inside a bellows type camera with a lens type shutter, the leaf being secured, such as by pins, to a support to lie in the camera focal plane. The leaf, after having been stored in darkness for a predetermined period to substantially deplete it of starch, is exposed for a predetermined time to a light image of an object by opening the shutter of the camera objective to focus the image of the object onto the geranium leaf. By way of example, the period of storage of the geranium leaf in darkness was between about 49 and 125 hours, the exposure of the leaf to the light image was between about 20 and 96 hours and the ratio of exposure to darkness time was between about 0.2 and 0.83, the average dark time being 93.7 hours and the average exposure time being 38.4 hours and the average exposure to darkness ratio being 0.436. It should be noted that the above parameters may be varied as desired and may depend on ambient and other conditions.

The exposed leaf having a latent starch image corresponding to the projected light image of the object, in order to remove the cholorophyll, was immersed in boiling water and then placed in a double boiler apparatus containing isopropyl alcohol. The leaf was then flooded with an iodine solution containing 1 gram iodine, 5 grams potassium iodide and 300 milliliters of water. The starch in the leaf was selectively dyed to develop the latent starch image and produce a fixed photographic image of the object to whose light image the leaf was exposed.

While the procedure described above was successful and photographs were produced, the use of a geranium leaf as the photographic medium possessed drawbacks and disadvantages. The image quality left something to be desired, the images had veins running through them and were grainy, with the resolution of a newsprint picture. Moreover, the required exposure time was excessively long and other drawbacks may be experienced.

To remedy the deficiencies of the use of a geranium leaf as the photographic medium, the photographic medium may comprise a film or layer including a starch free matrix having chloroplasts substantially uniformly dispersed therein, the chloroplasts being derived from or preferrably contained in algae or photosynthetic bacteria. The film or matrix material should be starch free and permeable to water, carbon dioxide and light. Examples of algae which may be employed are Chlorella, of the subdivision of chlorophyta, such algae having demonstrated its effectiveness in photosynthesis related processes and containing pyrenoids around which starch is deposited, as well as other stains belonging to the division chlorophyla. By way of example, a layer of an agar containing algae is produced by siphoning the fluid from the algae growth vessel leaving a slime-like deposit which was then rinsed off to yield a high algae content fluid which was then stored in darkness for a predetermined period. The resultant material was centrifuged to produce a pellet and the algae was mixed with liquid agar and poured onto a glass plate and allowed to cool and solidify. The use of agar possessed the drawback that being a carbohydrate it is stained by iodine to at least partially mask the developed image.

The drawbacks of the use of agar as the film matrix is overcome by using gelatin in its place. Chlorophyll removal prior to the iodine solution treatment is effected by extraction with methyl alcohol/petroleum ether 3/1.

In place of the algae, advantageously a photosynthetic bacteria may be employed as the photoresponsive chloroplast containing material dispersed in the starch free matrix to define the photographic medium, the photosynthetic bacteria being represented by order-Pseudomonadales, sub-order,- Rhodobacterrineae. The minute size (0.5–2 microns) of the bacteria permits the production of a finely imaged photographic medium. An example of the bacteria which may be employed is the bacterium Chlorobium Sulphatophelum, of the group Chlorobacteriaceae (green sulphur bacteria), Genus Chlorobium. The gram-negative bacterium Chlorobium Sulphonium is desirable since they are strictly autotrophic and consequently strictly anearobic making them ideal for emulsification and they are also non-motile. Further, with the photosynthetic bacteria carbohydrates appear around the chromatophores (bacterial chloroplasts) with a very short illumination.

While there have been described preferred embodiments of the present invention, it is apparent that numerous alterations, omissions and additions may be made without departing from the spirit thereof. For example, although the process has been described with the light image being projected onto the photographic medium by the objective lens of a camera the light image may be projected on the photographic medium by means of a photographic enlarger or through a negative superimposed on the photographic medium.

I claim:

1. The photographic process comprising exposing a layer including a starch impoverished matrix having chloroplasts distributed therein and in the presence of carbon dioxide and water to a light image of different intensities to produce starch in said layer in amounts varying with the quantities of incident light on respective areas of said layer whereby to produce a latent starch image and thereafter treating said starch with an iodine solution to darken said starch and develop said latent image to a visible image.

2. The process of claim 1 including the step of deactivating said chloroplasts after exposure of said layer to said light image.

3. The process of claim 1 wherein said chloroplasts have associated therewith their natural matrix.

4. The process of claim 1 wherein said layer is constituted of a vegetable plant leaf.

5. The process of claim 4 wherein said leaf is a gernaium leaf.

6. The process of claim 2 wherein said deactivating step includes immersing said layer in boiling alcohol.

7. The process of claim 1 including the step of storing said layer in darkness at least a predetermined period before its exposure to said light image to deplete said layer of starch.

* * * * *